US007108021B2

(12) United States Patent
Lile, Jr. et al.

(10) Patent No.: US 7,108,021 B2
(45) Date of Patent: Sep. 19, 2006

(54) TIE WRENCH FOR BENDING FENCE MOUNTING CLIPS AROUND FENCING WIRE TO SECURE FENCING WIRE TO A FENCE POST

(76) Inventors: Thomas A. Lile, Jr., 811 Percifield Trail, Alvarado, TX (US) 76009; Kenneth Lile, 14605 FM 639E, Barry, TX (US) 75102

( * ) Notice: Subject to any disclaimer, the term of this patent is extended or adjusted under 35 U.S.C. 154(b) by 268 days.

(21) Appl. No.: 10/827,221

(22) Filed: Apr. 19, 2004

(65) Prior Publication Data

US 2005/0229996 A1 Oct. 20, 2005

(51) Int. Cl.
*B21F 7/00* (2006.01)
*B21F 33/00* (2006.01)
*B25F 1/00* (2006.01)

(52) U.S. Cl. ..... 140/117; 140/57; 7/117

(58) Field of Classification Search ..... 140/51, 140/56–57, 117–118, 123–124, 149, 93.6, 140/93 R, 102.5, 104, 106; 81/3.55, 3.57; 7/156, 117, 166; 30/356
See application file for complete search history.

(56) References Cited

U.S. PATENT DOCUMENTS 526,718 A * 10/1894 Leyner ..... 140/102.5
542,827 A 7/1895 Horst
577,861 A 3/1897 Kirby
584,396 A * 6/1897 McNulty ..... 30/165
791,009 A * 5/1905 Cooper ..... 7/170
807,380 A * 12/1905 Hicks ..... 215/302
886,913 A * 5/1908 Zander ..... 81/3.57
942,732 A 12/1909 Morford
1,005,213 A * 10/1911 Hinds ..... 81/3.44
1,015,503 A * 1/1912 Merrill ..... 140/123
1,286,488 A 12/1918 Amberg
2,484,278 A * 10/1949 Fisher ..... 140/93 R
3,613,745 A 10/1971 Treiber
3,890,912 A * 6/1975 Young ..... 81/3.55
4,270,581 A 6/1981 Claxton et al.
4,917,154 A 4/1990 Roberson, Sr.
5,036,578 A * 8/1991 Rivera ..... 29/566.4
D368,006 S 3/1996 Aldrich
5,518,044 A 5/1996 Ferguson
5,649,572 A 7/1997 Lile
5,778,472 A 7/1998 Lang
5,909,910 A 6/1999 Shaffer
6,199,452 B1 * 3/2001 Vinar ..... 81/3.57
6,499,514 B1 12/2002 Hodge, Sr.

* cited by examiner

*Primary Examiner*—Derris H. Banks
*Assistant Examiner*—Teresa M Bonk
(74) *Attorney, Agent, or Firm*—Bracewell & Giuliani LLP

(57) ABSTRACT

A tie wrench for bending mounting clips to secure a fence wire to a fence post is disclosed. The tie wrench utilizes a hook that is positioned beneath the fence wire but above an outer portion of the mounting clip. The tie wrench is pulled toward the user to twist and secure the outer portion of the clip and the fence wire to the fence post. The other side of the clip is engaged and deformed in a similar manner by a flared finger that protrudes from the blade body of the tool. The large bend in the blade coupled with the small recess adjacent the exterior corner of the device seats the fence wire and produces a fencing tool that is easier and quicker to use compared to prior art devices.

15 Claims, 5 Drawing Sheets

TIE WRENCH FOR BENDING FENCE MOUNTING CLIPS AROUND FENCING WIRE TO SECURE FENCING WIRE TO A FENCE POST

BACKGROUND OF THE INVENTION

1. Technical Field

The present invention relates in general to an improved fencing tool and, in particular, to an improved system, method, and apparatus for bending both ends of wire fence mounting clips around fencing to secure the wire fence to a fence post.

2. Description of the Related Art

Farmers and ranchers typically utilize metal fence posts to erect various types of metal fencing. Some of the more common types of metal fencing include single strand, woven wire, and barbed wire fences, and are hereinafter referred to as "wire" fences. Maintaining fences in good condition requires almost continuous inspection and repair. Livestock, wild life, and weather elements continually work to loosen and break down fences. Thus, many farmers and ranchers are required to inspect and repair existing fences on a frequent basis.

Wire fences are typically attached to a metal fence post by the use of wire mounting clips. Mounting clips are short, pre-formed or bent pieces of wire that are designed to initially fit loosely around a fence post and the wire fencing to be secured to the fence post. After the mounting clip is in position, it must be further deformed to retain the fence wire on the fence post. Each mounting clip has a V-shaped central portion that receives the fence post, and opposing curled ends that pass around the fence wire on both sides of the fence post for fastening the fence wire to the fence post.

Mounting clips may be used to either initially erect a fence or to repair a fence that requires mending. Farmers and ranchers typically use a pair of pliers, a screwdriver, or other common hand tools to install and/or remove the mounting clips from the fence posts. However, using commonplace tools to tightly and securely fasten mounting clips to fence posts requires considerable effort. This is particularly true for the deformation of both sides of mounting clips.

In the prior art, there have been a number of attempts to develop hand tools for attaching fencing mounting clips. Some designs use a pivot hook with webs and recesses for grasping the clips. However, these designs have flat and wide blades that are cumbersome to use in the narrow spaces between the clips and the fence post. Other designs use hooked blades that pivot about a fence wire to wrap the outer portion of a mounting clip around the fence wire. However, those designs require perpendicular insertion of the wire completely through the blade to effect the wrap. Still other prior art designs bend clips or wire, but they do not engage the fence wire to do so. Thus, it would be desirable to have an improved fencing tool for use in wire fence installation, particularly to quickly and easily facilitate the attachment of a fence wire to a fence post with a mounting clip.

SUMMARY OF THE INVENTION

One embodiment of a system, method, and apparatus of a fencing tool of the present invention is used to mount a metal fence wire about a metal fence post using metal fence mounting clips. The fence post has a generally T-shaped cross-section. One face of the post has a plurality of longitudinally extending nubs on an exterior surface thereof for supporting fence wire that is attached thereto. The mounting clip has a generally V-shaped central portion that terminates in a pair of oppositely extending ends or loops. The V-shaped central portion is received about the rear of the fence post and the oppositely extending loops pass over and about the fence wire on both sides of the fence post. Portions of the fencing tool act as a cam surface that engages and cooperate with the fence wire for applying a bending force to the mounting clip being mounted.

The present invention acts as a mounting clip or tie wrench for bending clips to secure a fence wire to a fence post. The tie wrench utilizes a hook that is positioned beneath the fence wire but above an outer portion of the mounting clip. The tie wrench is then pulled toward the user to twist the outer portion of the mounting clip into a position that secures one side of the mounting clip and the fence wire to the fence post. The other side of the mounting clip is engaged and deformed in a similar manner by a flared finger that protrudes from the blade body of the tool at an inclined angle from the blade body. The large bend in the blade coupled with the small recess adjacent the exterior corner of the device seats the fence wire and produces a fencing tool that is easier and quicker to use compared to prior art devices.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 2:
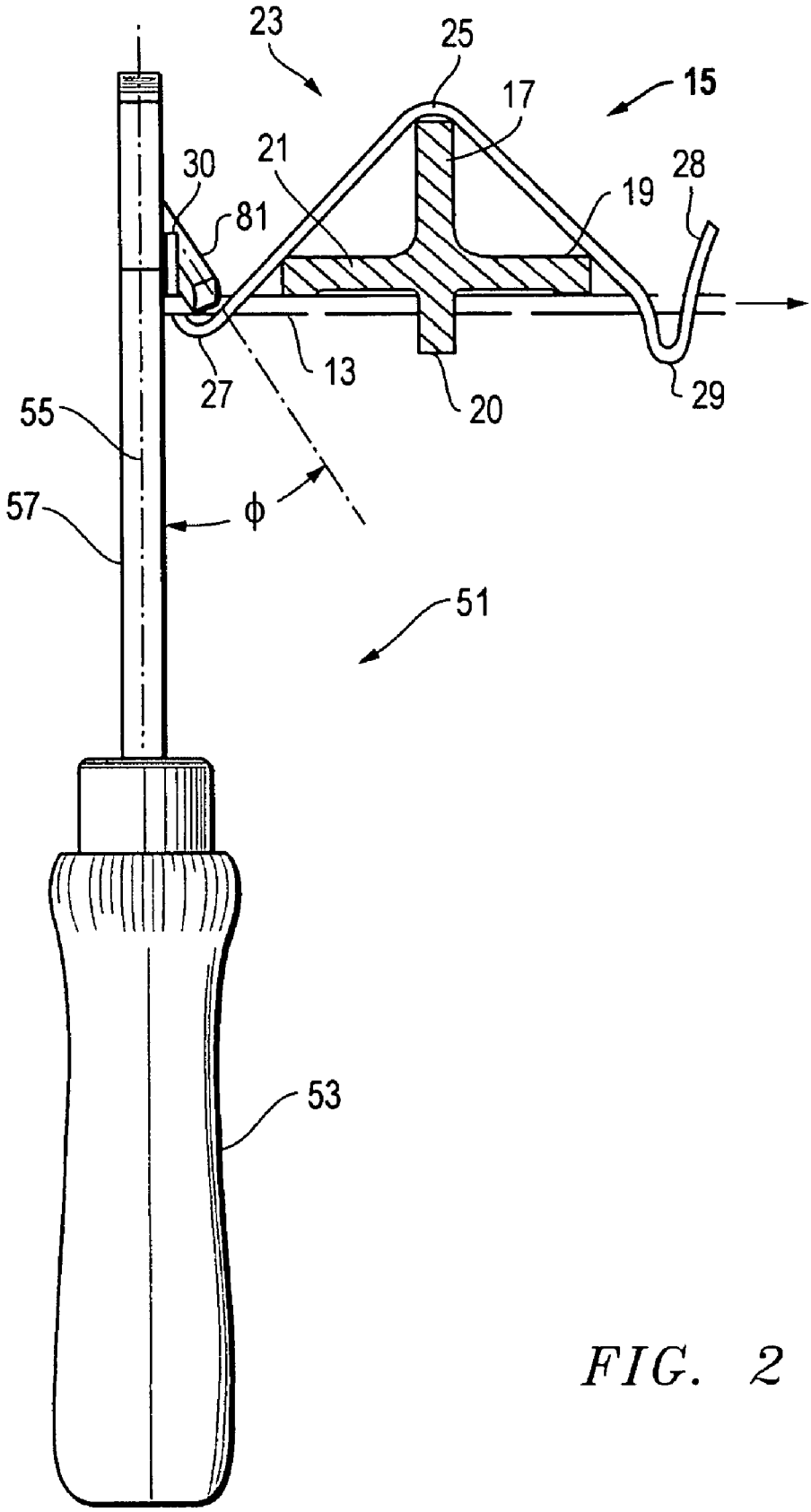
FIG. 2 is a top sectional view of a fence post and fence wire showing a mounting clip positioned thereon prior to deformation, and the fencing tool of FIG. 1.
Figure 3:
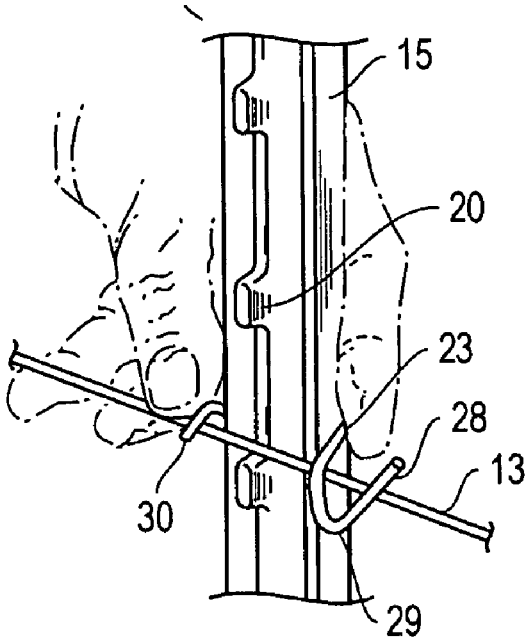
FIG. 3 (Prior Art)
FIG. 3 is a partial perspective view of the fence post, fence wire, and mounting clip of FIG. 2 showing an initial positioning of the mounting clip.

Referring to FIGS. 2 and 3, a conventional metal fence post 15 has a generally T-shaped cross-section formed by a center section 17 and side (e.g., left and right) opposing sections 19, 21, that are transverse to center section 17. A plurality of nubs 20 extend longitudinally down an exterior surface of the fence post 15. The fencing tool 11 of the present invention is used to deform conventional mounting clips 23 to attach fence wire 13 to fence posts 15. The stiff, metal mounting clip 23 has a generally V-shaped central portion 25 that terminates in a pair of oppositely extending loops 27, 29. The V-shaped central portion 25 receives the center section 17 of the fence post 15 with the oppositely extending loops 27, 29 passing over and about the fence wire 13 that is being attached to the fence post 15. In the embodiment shown, the clip 23 has one end 28 that flares upwardly in an opposite direction from an opposite end 30 thereof. The end 30 passes back under the fence wire 13 in the initial position while the end 28 flares upwardly on the wire side of the fence post 15. For ease of reference, loop 29 and end 28 may be collectively referred to as "an end" or "end 28," and the loop 27 and end 30 may be collectively referred to as "an end" or "the end 30."

Figure 1:
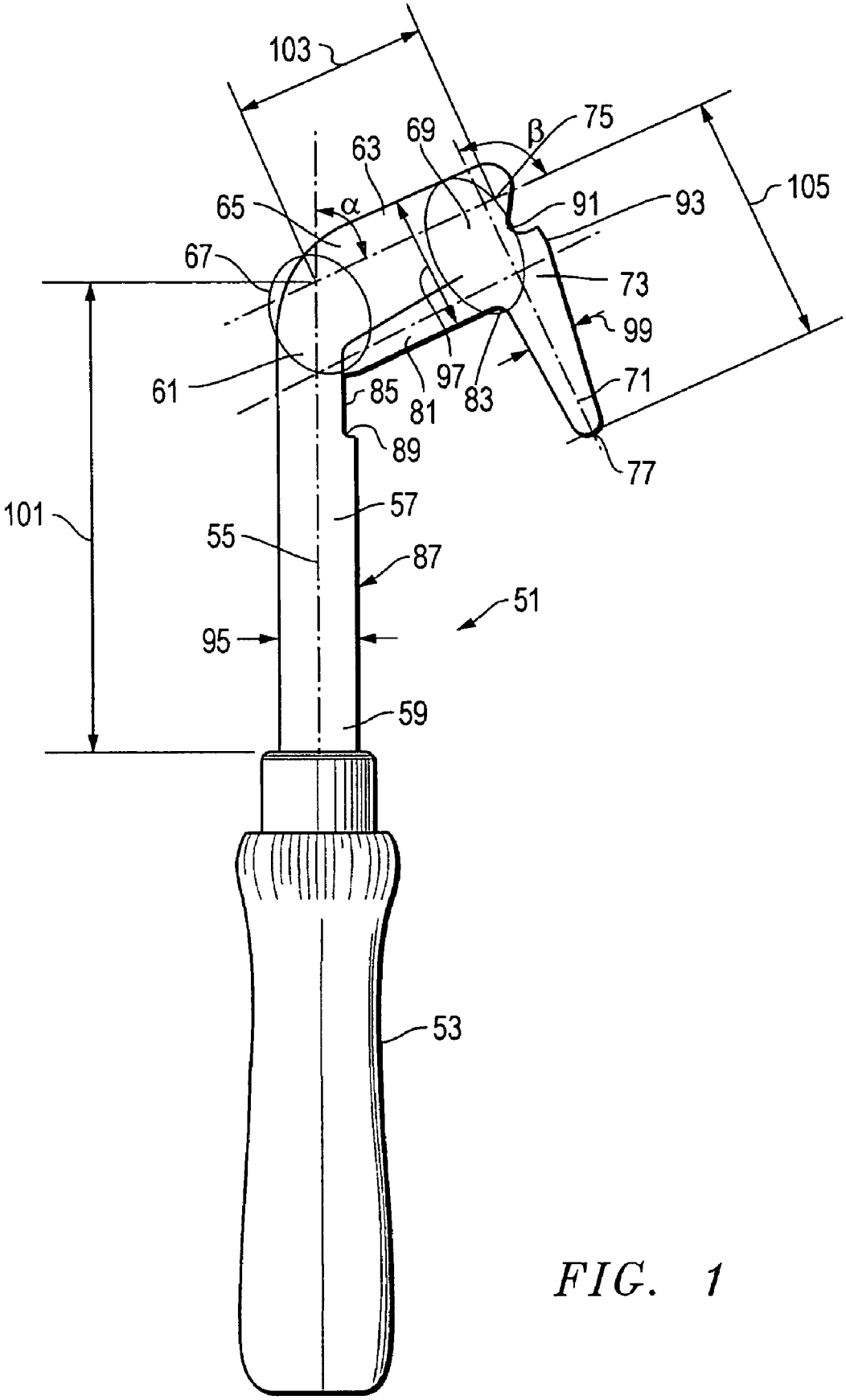
FIG. 1 is a side view of a fencing tool constructed in accordance with the present invention.

Referring now to FIGS. 1 and 2, one embodiment of a fencing tool 51 constructed in accordance with the present invention is shown. Tool 51 is used to secure the fence wire 13 to the fence post 15 with the mounting clip 23. Tool 51 has a handle 53 (e.g., contoured wood) with an axis 55. A rigid body 57 (e.g., metal) extends in a generally axial direction from the handle 53. The body 57 has a body proximal end 59 located adjacent to the handle 53, and a body distal end 61 located opposite the body proximal end 59.

An intermediate portion 63 extends from the body distal end 61 at an intermediate angle $\alpha$ with respect to the axis 55. The intermediate portion 63 has an intermediate proximal end 65 that forms a first intersection 67 with the body distal end 61, and an intermediate distal end 69 located opposite the intermediate proximal end 65. A terminal portion 71 extends from the intermediate distal end 69 at a terminal angle $\beta$, such that the terminal portion 71 is oriented in a different configuration than the intermediate portion 63 with respect to the body 57. In one embodiment, intermediate angle $\alpha$ is approximately 60°, and terminal angle $\beta$ is 90°. The terminal portion 71 has a terminal proximal end 73 that forms a second intersection 75 with the intermediate distal end 69, and a terminal distal end 77 that is opposite the terminal proximal end 73.

The tool 51 further comprises an appendage or finger 81 that extends from the second intersection 75 at a finger angle $\phi$ (FIG. 2) relative to the axis 55. Although finger 81 is shown on the right side of the body 57 in FIG. 2, in alternate embodiments it may be positioned on the left side, or reconfigured as two fingers 81 with one on each side of body 57. The body 57, the intermediate portion 63, and the terminal portion 71 are co-planar and define a continuous flat blade of, for example, 10 gauge steel (approximately 0.125 inches thick). Thus, tool 51 has a very slender profile that allow it to access even difficult-to-reach locations and positions. The finger 81 is bent out of plane with respect to the continuous flat blade at finger angle $\phi$, which in one embodiment is approximately 30°. The finger 81 is also skewed relative to portion 63 and, thus, oriented at the same angle $\alpha$ (see FIG. 1).

Figure 5:
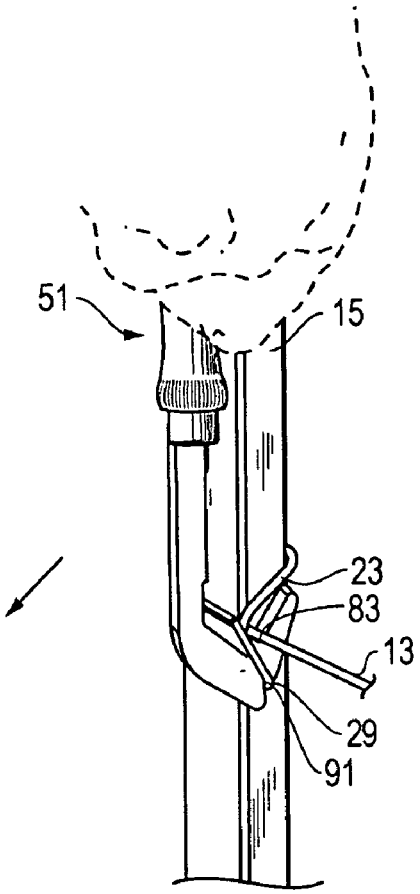
Figure 6:
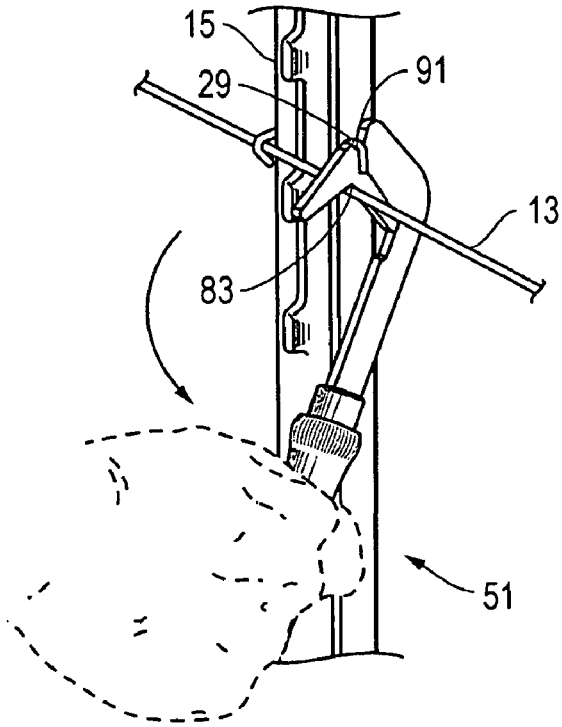
Figure 7:
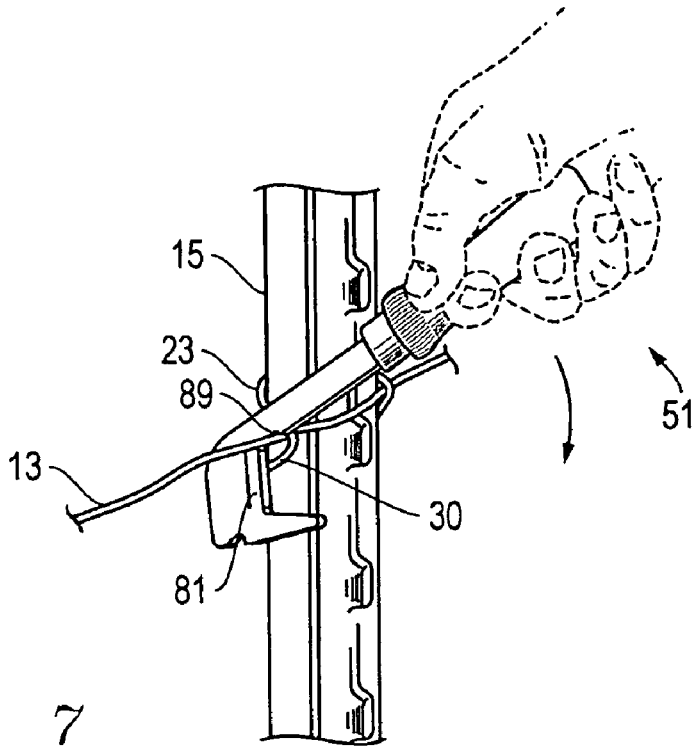
Figure 8:
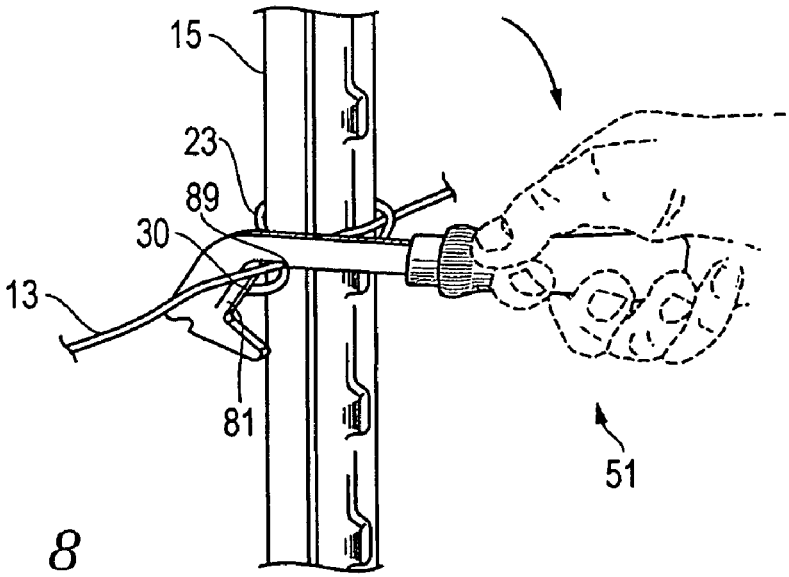

In the preferred embodiment all of body 57, portions 63, 71, and finger 81 are formed from a single, integral piece of thick flat metal. A first pocket 83 is formed between the terminal portion 71 and the finger 81 for seating the fence wire 13 (FIGS. 5 and 6). A notch 85 is formed on an inner edge 87 of the body 57 adjacent to the first intersection 67. The notch 85 has a lip 89 that is axially offset from the first intersection 67. The lip 89 forms a second pocket (FIGS. 7 and 8) for seating the fence wire 13.

Figure 4:
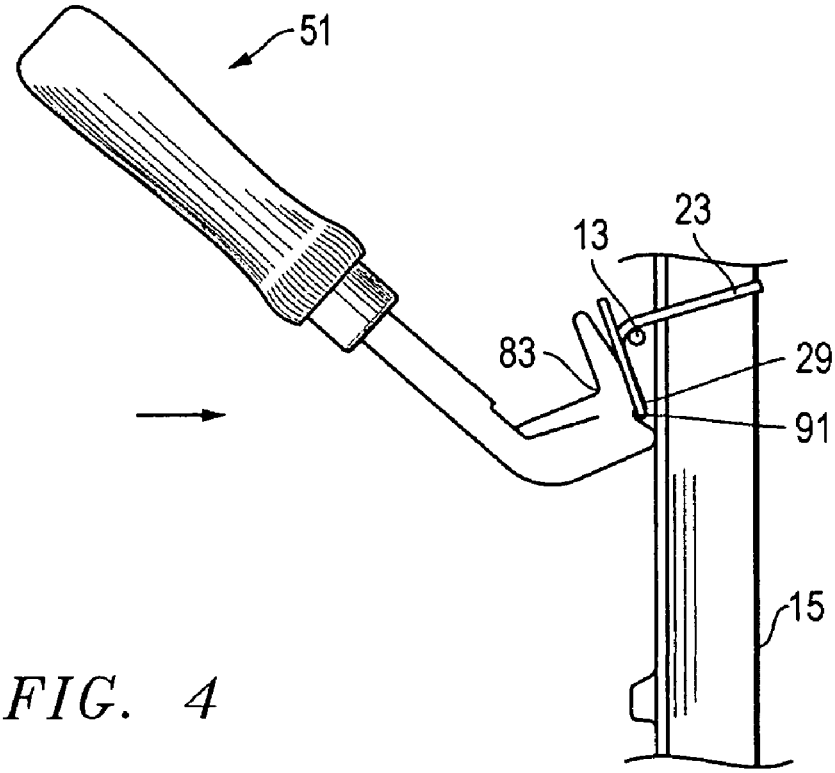
FIGS. 4–8 are partial perspective views showing the sequential operational steps of use of the fencing tool of FIG. 1 installing a fence wire on a fence post with a mounting clip.

The tool 51 also includes a concave recess 91 is formed in an outer edge 93 of the terminal portion 71 adjacent to the second intersection 75. The concave recess 91 has a radius of curvature that is adapted to receive a portion of a mounting clip 23 (FIGS. 4–6). The body 57 has a first width 95, the intermediate portion 63 has a second width 97 that is greater than the first width 95, and the terminal portion 71 has a third width 99 that is less than the first width 85. In addition, the body 57 has a first length 101, the intermediate portion 63 has a second length 103 that is less than the first length 101, and the terminal portion 71 has a third length 105 that is greater than the second length 103.

The present invention also comprises a method of securing a fence wire 13 to a fence post 15 with a mounting clip 23. One embodiment of the method comprises positioning a tool 51 on one side of the fence post 15 (FIGS. 4–6). The handle 53 should be oriented above the U-shaped body 57 and closer to the user than the body 57. As shown in FIG. 4, the method optionally first comprises pushing end 29 of the mounting clip 23 away from the user to slightly deform the mounting clip 23 into a better twisting position. In this step, the end 29 may be placed in recess 91 without tool 51 actually touching fence wire 13. As shown in FIG. 5, the method further comprises seating the fence wire 13 in a first pocket 83 in the tool 51, and one of the loops 29 in the recess 91 in the tool 51. The tool 51 is then rotated toward the user about the fence wire 13 (FIG. 6) in the first pocket 83 to bend said one of the loops 29 (and end 28) around the fence wire 13. In this step, the entire loop 29 is bent around the fence wire 13.

After the first loop 29 (e.g., right side in FIGS. 5 and 6) of the mounting clip 23 is deformed, the tool 51 is disengaged from that side of the fence wire 13 and said one of the loops 29, and repositioned on the other side (e.g., left side in FIG. 2) of the fence post 15. This embodiment of the method further comprises seating the fence wire 13 in a second pocket 89 (FIG. 7) in the tool 51 and contacting the other end 30 with a finger 81 extending from the tool 51. The tool 51 is then rotated about the fence wire 13 (FIG. 8) in the second pocket 81 to bend said other end 30 around the fence wire 13. In this step, only the end 30 of the loop 28 is bent around the fence wire 13.

The method optionally comprises configuring the finger 81 out of plane with respect to a main body 57 of the tool 51, seating the fence wire 13 in a concave recess 91 formed on an outer edge 93 of the tool 51, and/or seating the fence wire 13 in a rectangular notch 81 formed on an inner edge 87 of the tool 51.

The present invention has several advantages, and is simple in design and economical to manufacture. The fencing tool has features that facilitate grasping and exerting a bending force on a V-shaped mounting clip for installing a fence wire on a fence post. The curved edge regions of the tool exert cam forces on the fence wire to facilitate the bending movement of the mounting clip. Portions of the fencing tool act as a cam surface that engages and cooperate with the fence wire for applying a bending force to the mounting clip being mounted.

The present invention is a tie wrench for bending mounting clips to secure a fence wire to a fence post. Unlike prior art devices that are limited to use with wide-spaced barbed wire fencing, the tie wrench is small and has a very slender profile that make it ideal for fencing with more limited fence spacings. The tie wrench utilizes a hook that is positioned beneath the fence wire but above an outer portion of the mounting clip. The tie wrench is then pulled toward the user to twist the outer portion of the mounting clip into a position that secures one side of the mounting clip and the fence wire to the fence post. The other side of the mounting clip is engaged and deformed in a similar manner by a flared finger that protrudes from the blade body of the tool at an inclined angle from the blade body. The large bend in the blade coupled with the small recess adjacent the exterior corner of the device seats the fence wire and produces a fencing tool that is easier and quicker to use compared to prior art devices. Unlike some conventional devices, no throughholes or apertures are required to be formed in the tool in order to engage and/or deform the mounting clip.

While the invention has been shown or described in only some of its forms, it should be apparent to those skilled in the art that it is not so limited, but is susceptible to various changes without departing from the scope of the invention.

What is claimed is:

1. A fencing tool, comprising:

a body having an axis, a body proximal end, and a body distal end located opposite the body proximal end;

an intermediate portion extending from the body distal end at an intermediate angle with respect to the axis, the intermediate portion having an intermediate proximal end that forms a first intersection with the body distal end, and an intermediate distal end located opposite the intermediate proximal end;

a terminal portion extending from the intermediate distal end at a terminal angle, such that the terminal portion is oriented in a different configuration than the intermediate portion with respect to the body, the terminal portion having a terminal proximal end that forms a second intersection with the intermediate distal end and a terminal distal end that is opposite the terminal proximal end;

a finger extending from the second intersection at a finger angle that is out of plane with respect to the intermediate and terminal portions; and a concave recess formed in an outer edge of the terminal portion adjacent to the second intersection.

2. The fencing tool of claim 1, wherein the body, the intermediate portion, and the terminal portion are co-planar and define a continuous flat blade, and the finger is out of plane with respect to the continuous flat blade.

3. The fencing tool of claim 1, wherein the intermediate angle is approximately 60°, the terminal angle is approximately 90°, and the finger angle is approximately 30°.

4. The fencing tool of claim 1, wherein the body has a first width, the intermediate portion has a second width that is greater than the first width, and the terminal portion has a third width that is less than the first width.

5. The fencing tool of claim 1, wherein the body has a first length, the intermediate portion has a second length that is less than the first length, and the terminal portion has a third length that is greater than the second length.

6. The fencing tool of claim 1, wherein the terminal distal end is radiused, and a pocket is formed between the terminal portion and the finger that is adapted to seat a fence wire.

7. The fencing tool of claim 1, further comprising a notch formed on an inner edge of the body adjacent to the first intersection, the notch having a lip that is generally rectangular and axially offset from the first intersection, wherein the lip forms a pocket that is adapted to seat a fence wire.

8. A fencing tool for securing a fence wire to a fence post with a mounting clip, the mounting clip having a central portion that terminates in a pair of loops on opposite sides of the central portion, the fencing tool comprising:

a handle having an axis;

a body extending in a generally axial direction from the handle, the body having a body proximal end located adjacent to the handle and a body distal end located opposite the body proximal end;

an intermediate portion extending from the body distal end at an intermediate angle with respect to the axis, the intermediate portion having an intermediate proximal end that forms a first intersection with the body distal end, and an intermediate distal end located opposite the intermediate proximal end;

a terminal portion extending from the intermediate distal end at a terminal angle, such that the terminal portion is oriented in a different configuration than the intermediate portion with respect to the body, the terminal portion having a terminal proximal end that forms a second intersection with the intermediate distal end and a terminal distal end that is opposite the terminal proximal end;

a finger extending from the second intersection at a finger angle;

a first pocket is formed between the terminal portion and the finger for seating the fence wire;

a notch formed on an inner edge of the body adjacent to the first intersection, the notch having a lip that is axially offset from the first intersection, the lip forming a second pocket for seating the fence wire; and a concave recess formed in an outer edge of the terminal portion adjacent to the second intersection, the concave recess having a radius of curvature that is adapted to receive a portion of a mounting clip.

9. The fencing tool of claim 8, wherein the body, the intermediate portion, and the terminal portion are co-planar and define a continuous flat blade, and the finger is out of plane with respect to the continuous flat blade.

10. The fencing tool of claim 8, wherein the intermediate angle is approximately 60°, the terminal angle is approximately 90°, and the finger angle is approximately 30°.

11. The fencing tool of claim 8, wherein the body has a first width, the intermediate portion has a second width that is greater than the first width, and the terminal portion has a third width that is less than the first width; and wherein the body has a first length, the intermediate portion has a second length that is less than the first length, and the terminal portion has a third length that is greater than the second length.

12. A method of securing a fence wire to a fence post with a mounting clip, the mounting clip having a central portion that receives the fence post and a pair of ends on opposite sides of the central portion and fence post, the method comprising:

(a) positioning a tool on one side of the fence post;

(b) seating the fence wire in a first pocket in the tool and one of the ends in a recess in the tool;

(c) rotating the tool about the fence wire in the first pocket to bend said one of the ends around the fence wire;

(d) disengaging the tool from the fence wire and said one of the ends and repositioning the tool on the other side of the fence post;

(e) seating the fence wire in a second pocket in the tool and contacting the other end with a finger extending from the tool; and (f) rotating the tool about the fence wire in the second pocket to bend said other end around the fence wire.

13. The method of claim 12, wherein step (e) comprises configuring the finger out of plane with respect to a main body of the tool.

14. The method of claim 12, wherein step (b) comprises seating the fence wire in a concave recess formed on an outer edge of the tool.

15. The method of claim 12, wherein step (e) comprises seating the fence wire in a notch formed on an inner edge of the tool.

* * * * *